US010454200B2

(12) United States Patent
Uenosono et al.

(10) Patent No.: US 10,454,200 B2
(45) Date of Patent: Oct. 22, 2019

(54) CONNECTOR WITH LOCKING WIRE HOLDER

(71) Applicant: YAZAKI CORPORATION, Tokyo (JP)

(72) Inventors: Daisuke Uenosono, Shizuoka (JP); Takashi Tsukamoto, Shizuoka (JP); Yoshitaka Tsushima, Shizuoka (JP); Shoya Ueda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/989,095

(22) Filed: May 24, 2018

(65) Prior Publication Data

US 2018/0342827 A1 Nov. 29, 2018

(30) Foreign Application Priority Data

May 26, 2017 (JP) ..... 2017-104656

(51) Int. Cl.
*H01R 13/40* (2006.01)
*H01R 13/436* (2006.01)

(52) U.S. Cl.
CPC ..... *H01R 13/436* (2013.01); *H01R 13/4362* (2013.01)

(58) Field of Classification Search
CPC ..... H01R 13/436; H01R 13/4362
USPC ..... 439/603
See application file for complete search history.

(56) References Cited

U.S. PATENT DOCUMENTS 4,787,864 A * 11/1988 Hunt, III ..... H01R 13/4367 439/595
4,806,123 A * 2/1989 Konishi ..... H01R 13/4364 439/595
5,002,504 A * 3/1991 Carlson ..... H01R 13/506 439/595

(Continued)

FOREIGN PATENT DOCUMENTS

CN 102810784 A 12/2012
JP 6-251821 A 9/1994

(Continued)

OTHER PUBLICATIONS

Chinese Office Action for the related Chinese Patent Application No. 201810516961.6 dated Jun. 5, 2019.

*Primary Examiner* — Abdullah A Riyami
*Assistant Examiner* — Vladimir Imas
(74) *Attorney, Agent, or Firm* — Kenealy Vaidya LLP

(57) ABSTRACT

A connector includes a housing that has a terminal accommodating chambers into which terminals are inserted and a housing flexible piece for locking and preventing the terminals from coming off, a rear holder that includes terminal insertion openings and is mounted on the housing at a temporary locking position and a final locking position, the retainer part is disposed at a position just before the retainer is engaged with the housing flexible piece when the rear holder is at the temporary locking position, and the retainer part is disposed at a position where the retainer part restrains the locking release of the housing flexible piece when the rear holder is at the final locking position, and a rail part that is formed in the housing and restrains a movement of the retainer in an inclination direction of a mounting direction by slide contact to the retainer part.

6 Claims, 7 Drawing Sheets

(56) References Cited

U.S. PATENT DOCUMENTS

| | | | | |
|---|---|---|---|---|
| 5,076,806 | A * | 12/1991 | Hotea | H01R 13/42 439/278 |
| 6,599,153 | B2 * | 7/2003 | Nishide | H01R 13/6456 439/271 |
| 8,469,751 | B2 * | 6/2013 | Oiri | H01R 43/22 439/701 |
| 8,721,373 | B2 * | 5/2014 | Suzuki | H01R 13/506 439/589 |
| 9,505,313 | B2 * | 11/2016 | Shimizu | H01R 13/4367 |
| 10,063,008 | B2 * | 8/2018 | Kawai | H01R 13/5812 |
| 2002/0039862 | A1 * | 4/2002 | Nishide | H01R 13/6456 439/701 |
| 2011/0287666 | A1 * | 11/2011 | Nishi | H01R 4/028 439/660 |
| 2012/0289090 | A1 * | 11/2012 | Oiri | H01R 13/4223 439/625 |
| 2012/0309219 | A1 | 12/2012 | Hiraishi | |
| 2016/0072224 | A1 * | 3/2016 | Ichio | B60L 11/1818 439/345 |
| 2016/0111831 | A1 * | 4/2016 | Kawai | H01R 13/04 439/620.21 |
| 2016/0126681 | A1 * | 5/2016 | Kawai | H01R 13/582 439/620.21 |

FOREIGN PATENT DOCUMENTS

| | | | |
|---|---|---|---|
| JP | 10-189146 | A | 7/1998 |
| JP | 2000-12148 | A | 1/2000 |
| JP | 2015-8099 | A | 1/2015 |

* cited by examiner

CONNECTOR WITH LOCKING WIRE HOLDER

CROSS REFERENCE TO RELATED APPLICATION

This application is based on Japanese Patent Application No. 2017-104656 filed on May 26, 2017, the contents of which are incorporated herein by reference.

BACKGROUND OF THE INVENTION

1. Technical Field

The present invention relates to a connector.

2. Background Art

A rear holder for holding an electric wire connected to a terminal is mounted on a connector (see, for example, JP-A-2015-008099). In the connector of JP-A-2015-008099, the electric wire to which the terminal is connected is installed in an electric wire installation part of a first holder (the rear holder).

By installing a second holder in the first holder, the electric wire is sandwiched and fixed between the first holder and the second holder. In this connector, the assembly is completed by installing the first holder in which the electric wire and the second holder are installed in a connector housing.

In addition, this type of connector includes a front holder having an annular sealing member. In the front holder, a front flexible piece is locked and mounted on a front locking part of the connector housing. In a connector including this kind of front holder, a gap between a connector fitting part of the connector housing and a mating connector can be water-tightly sealed with a sealing member.

However, in the conventional connector, the number of parts such as the terminal and the rear holder for holding the electric wire is large and the assembly man-hour is large and the assembly work is complicated. In addition, since the terminal or the front holder is of a single locking structure, the possibility of deviation could not be completely denied and assembly failure may be generated.

The present invention has been made in view of the above conditions, and an object is to provide a connector that can facilitate the assembly work and prevent the assembly failure.

SUMMARY OF THE INVENTION

The above object according to the present invention is achieved by the following configuration.

(1) A connector, comprising: a housing which has a plurality of terminal accommodating chambers into which terminals are inserted and a housing flexible piece for locking so as to prevent the terminals from coming off in each of the terminal accommodating chambers; a rear holder which includes terminal insertion openings allowing insertion of the terminals and is mounted on the housing at two positions on a straight line, i.e., a temporary locking position and a final locking position, in which the retainer part is disposed at a position just before the housing flexible piece is engaged when the rear holder is in the temporary locking position, and the retainer part is disposed at a position that restrains the locking release of the housing flexible piece when the rear holder is at the final locking position; and a rail part which formed in the housing, sliding contacts the retainer part and restrains the inclination in the inclination direction with respect to the rear holder mounting direction of the retainer part.

(2) The connector according to the above (1), wherein a connector fitting part whose outer periphery is coupled to a mating connector is formed in the housing, a front holder including an annular sealing member elastically contacting the mating connector is mounted on the connector fitting part, a front flexible piece locking a front locking part formed in the housing is formed in the front holder, and a front retainer part engaged with the front flexible piece and restraining the locking release of the front flexible piece is formed in the rear holder.

According to the connector of the configuration of the above (1), the rear holder is mounted on the housing at the temporary locking position before the terminal is mounted. The rear holder includes a terminal insertion opening. In the housing, the terminal can be inserted into the terminal accommodating chamber through the terminal insertion opening of the rear holder mounted on the temporary locking position. Since the mounting work of the terminal can be assembled in a state where the rear holder is temporarily locked, it is unnecessary to perform a difficult operation such as pushing through the electric wire. As a result, the assembly work of the connector can be facilitated.

When the terminal is inserted into the terminal accommodating chamber, the terminal is locked to the housing flexible piece and the separation of the terminal from the terminal accommodating chamber in a direction opposite to the insertion direction is restrained. The rear holder is at the final locking position by further moving from the temporary locking position in the rear holder mounting direction. The rear holder is at the final locking position, so that the retainer part is inserted into the flexible space of the housing flexible piece. The retainer part is inserted into the flexible space of the housing flexible piece, so that locking release with respect to the terminal is restrained. That is, the terminal is brought into a double locking state, and the holding reliability is improved. As a result, the connector can prevent the assembly failure through the deviation of the terminal.

When the rear holder is moved to the final locking position, the retainer part is guided by the rail part. The retainer part is guided while being in sliding contact with the rail part, so that the inclination in the inclination direction with respect to the rear holder mounting direction is restrained. Even if the rear holder is mounted through the guide action of the rail part in an inclined way, the retainer part does not contact the housing flexible piece locked to the terminal in the proper position. That is, since the contact of the retainer part with the housing flexible piece is suppressed in the rear holder, smooth mounting work can be performed. The assembly work of the connector can be facilitated because of the smooth mounting property.

According to the configuration of the above (2), the front holder is mounted on the connector fitting part of the housing. The front flexible piece is locked to the front locking part of the housing, so that the separation of the front holder from the connector fitting part is restrained. The front holder is provided with a sealing member. When the mating connector is fitted to the connector fitting part, the sealing member water-tightly seals the gap between the connector fitting part and the mating connector. Since the seal member is in sliding contact with the mating connector, the front holder is required to have high holding performance with respect to the housing. That is, when the mating connector is pulled out, the separation of the front holder from the housing by friction must be surely prevented. In the connector, the rear holder is at the final locking position, so that the front retainer part of the rear holder is engaged with the front flexible piece of the front holder. The front retainer part is engaged with the front flexible piece, so that the locking release with respect to the front locking part is restrained. That is, the front holder is in a double locking state. As a result, the connector can suppress the assembly failure through the deviation of front holder.

According to the connector of the present invention, the assembly work can be facilitated and the assembly failure can be prevented.

The present invention has been briefly described above. Further, the details of the present invention will be clarified by reading a mode (hereinafter, referred to as "embodiment") for carrying out the invention described below with reference to the attached drawings.

DETAILED DESCRIPTION OF EMBODIMENTS

Embodiments of the present invention will be described with reference to the drawings.

Figure 1:
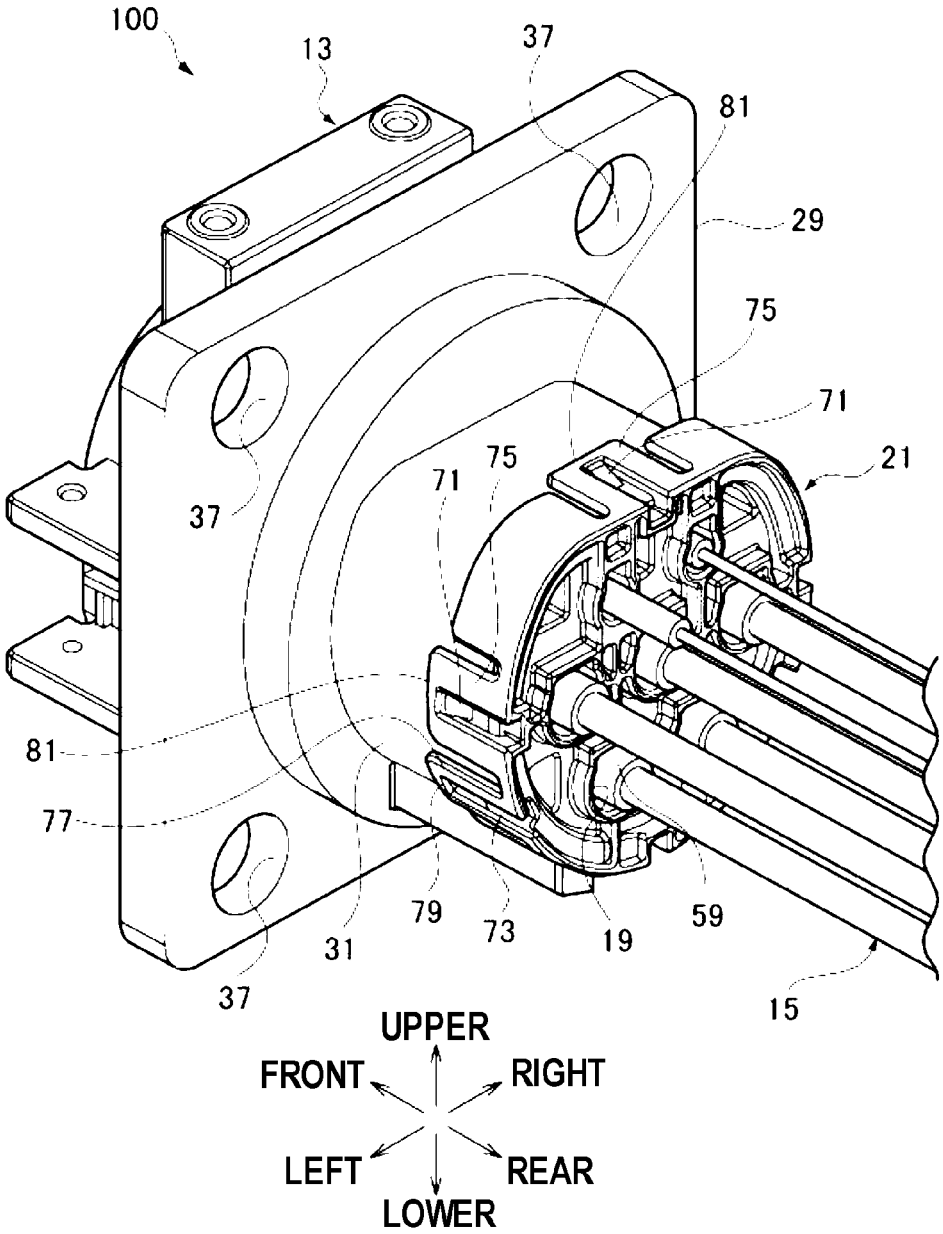
FIG. 1 is a perspective view of a connector according to an embodiment of the present invention as viewed obliquely upward from the rear left side.
Figure 2:
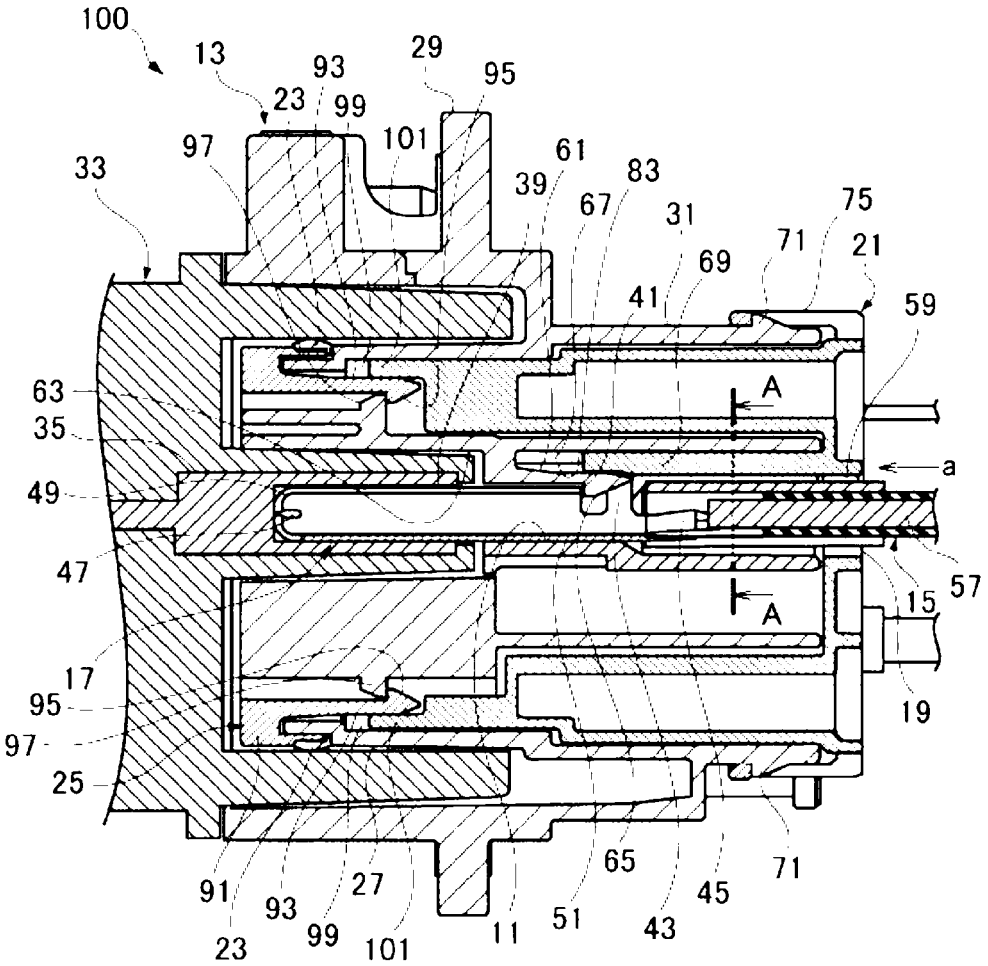
FIG. 2 is a longitudinal sectional view of the connector shown in FIG. 1 in a state of being coupled to a mating connector.

FIG. 1 is a perspective view of a connector according to an embodiment of the present invention as viewed obliquely upward from the rear left side, and FIG. 2 is a longitudinal sectional view of the connector shown in FIG. 1 in a state of being coupled to a mating connector.

Incidentally, in the present embodiment, upper and lower, front and rear, left and right directions follow the directions of arrows shown in FIG. 1.

The connector according to the present embodiment can be preferably used for, for example, a power-receiving side connector loaded on a vehicle. Of course, the connector according to the present invention may be used as a power-feeding side connector. Hereinafter, in the present embodiment, the connector is described as a charging connector 100 loaded on the vehicle.

The charging connector 100 has a housing 13 having a plurality of terminal accommodating chambers 11, terminals 17 connected to ends of electric wires 15 and accommodated in each of the terminal accommodating chambers 11, a rear holder 21 having terminal insertion openings 19, and a front holder 25 having a seal member 23 as main components.

The housing 13 is a casing made of an insulating resin and has a connector fitting part 27, an attaching flange part 29 projecting laterally from the connector fitting part 27, and an inner tubular portion 31 projecting from the attaching flange part 29 on the side opposite to the connector fitting part 27. On the front end surface of the connector fitting part 27, the tip end sides of the plurality of terminal accommodating chambers 11 are open, and a mating female terminal 35 of a mating connector 33 (see FIG. 2) which is the power-feeding side connector is inserted through the openings. The tip end surface of the connector fitting part 27 is opened and closed by a lid (not shown). The charging connector 100 is bolted to the vehicle body side using attaching holes 37 of the attaching flange part 29. On the rear end surface of the inner tubular portion 31, each of the terminal accommodating chambers 11 is open. Electric wires 15 such as electric wires for power supply, electric wires for grounding and electric wires for signals connected to each of the terminals 17 are drawn into the vehicle body through these openings.

The plurality of terminals 17 are inserted into the respective terminal accommodating chambers 11. The plurality of terminals 17 are, for example, terminals for receiving power connected to electric wires for power supply, terminals for grounding connected to electric wires for grounding, or the like.

The terminal 17 is formed by press working (punching processing, folding processing) from a metal plate of one conductive metal (copper, a copper alloy, etc.). Incidentally, the terminal 17 may be formed in a substantially cylindrical shape by cutting a conductive metal.

The terminal 17 includes a mating terminal contact part 39, a locking rear end portion 41, rising parts 43, and an electric wire connecting part 45.

The mating terminal contact part 39 is formed in a cylindrical shape. At the tip end of the mating terminal contact part 39, four slits 47 (one of the four slits is a folded joint part) cut backward are formed at equal intervals in the circumferential direction. In the mating terminal contact part 39, respective small piece parts sandwiched between the slits are bent inward in the radial direction, so that the tip end becomes a dome part 49. That is, the tip end of the cylindrical body (the mating terminal contact part 39) becomes a male terminal closed by the dome part 49. The inner peripheral surface of the mating female terminal 35 is in contact with the outer peripheral surface of the mating terminal contact part 39.

The locking rear end portion 41 is a circular arc-shaped rear end surface of the mating terminal contact part 39 formed in a cylindrical shape. The locking rear end portion 41 becomes a locked portion which prevents the terminal 17 from coming off the housing 13. A housing flexible piece 61 of the housing 13 described later is engaged with the locking rear end portion 41.

The terminal 17 has a bottom plate part 51 extending from the lower portion of the rear end of the mating terminal contact part 39. The bottom plate part 51 has a pair of left and right rising parts 43 erected upward from both left and right side edges. The rising parts 43 abut a stopper step part 53 (see FIG. 4) of the housing 13 to restrain forward coming-off of the terminal 17.

The bottom plate part 51 forms an electric wire connecting part 45 behind the rising parts 43. The electric wire connecting part 45 has a pair of left and right caulking pieces 55 erected upward from both left and right side edges of the bottom plate part 51. The caulking piece 55 is bent inward so as to wrap around a conductor 57 of the electric wires 15, and thus the conductor 57 is caulked in a state of being in close contact with the upper surface of the bottom plate part 51 (see FIG. 4).

The section between the electric wire connecting part 45 and the electric wires 15 is waterproofed by covering the outer peripheral surface thereof with a heat shrinkable tube 59.

In the terminal accommodating chamber 11 of the housing 13, a housing flexible piece 61 for fixing and preventing the terminal 17 from coming off is formed. The housing flexible piece 61 is formed in a cantilever shape having the base part connected to a ceiling surface 63 of the respective terminal accommodating chambers 11. The housing flexible piece 61 is disposed in the terminal accommodating chamber 11 such that a free end (a projecting tip end) on the side opposite to the base part extends toward the rear of the housing along the inserting direction of the terminal 17. The projecting tip end of the housing flexible piece 61 is disposed between the pair of rising parts 43 of the terminal 17 (see FIG. 4).

A locking stepped part 65 is formed on the lower surface of the projecting tip end of the housing flexible piece 61. The locking stepped part 65 locks the locking rear end portion 41 which is the locked part of the terminal 17 and restrains rearward coming-off of the terminal 17. When the terminal 17 is inserted, the housing flexible piece 61 is pushed up by the dome part 49 of the mating terminal contact part 39. When the terminal 17 is inserted to a predetermined position, the locking stepped part 65 of the housing flexible piece 61 coincides with the locking rear end portion 41. When the housing flexible piece 61 coincides with the locking rear end portion 41, it returns to the original position by the elastic restoring force and locks the locking rear end portion 41 (state of FIG. 2).

The terminal receiving chamber 11 has a flexible space 67 between the ceiling surface 63 and the projecting tip end of the housing flexible piece 61. On one hand, the flexible space 67 allows the projecting tip end of the housing flexible piece 61 pushed up by the mating terminal contact part 39 of the terminal 17 to move. On the other hand, when the retainer part 69 of the rear holder 21 is inserted into the flexible space 67 of the housing flexible piece 61, locking release with respect to the terminal 17 is restrained. In this specification, a state in which the locking release of the housing flexible piece 61 with respect to the terminal 17 is restrained by the retainer part 69 is referred to as a double locking state of the terminal 17.

Figure 3A:
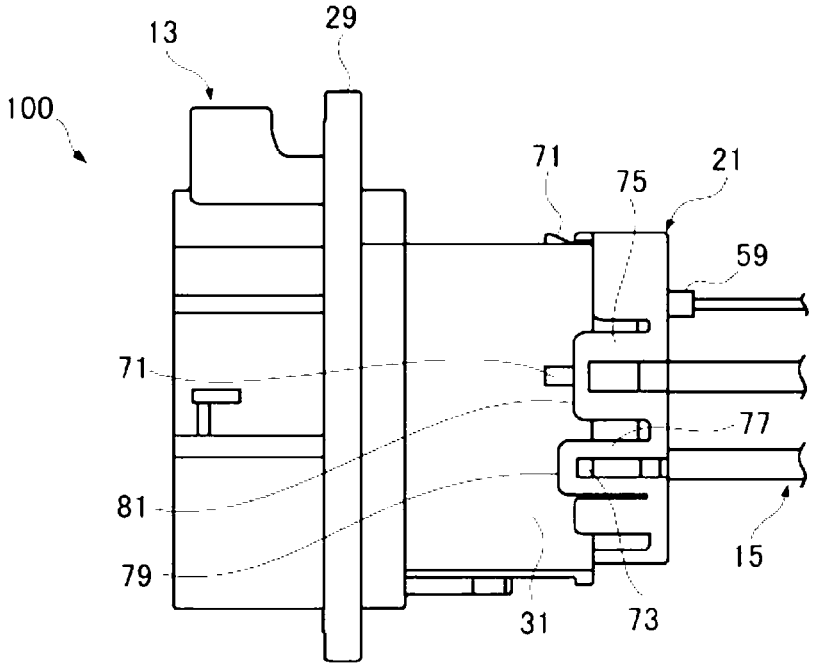
FIG. 3A is a side view of the connector when a rear holder shown in FIG. 2 is at a temporary locking position with respect to a housing.
Figure 3B:
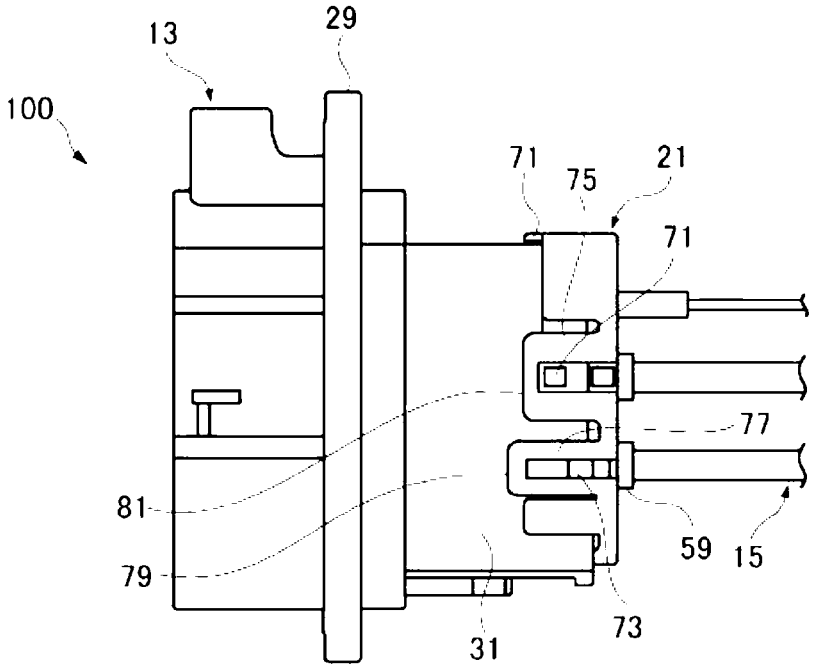
FIG. 3B is a side view of the connector when the rear holder shown in FIG. 2 is at a final locking position with respect to the housing.

FIG. 3A is a side view of the connector when a rear holder 21 shown in FIG. 2 is at a temporary locking position with respect to a housing 13, and FIG. 3B is a side view of the connector when the rear holder 21 shown in FIG. 2 is at a final locking position with respect to the housing 13.

In the housing 13, a plurality of (in the present embodiment, a pair of upper and lower and a pair of left and right, i.e., a total of four) final locking projections 71 for finally locking the rear holder 21 are projected from the outer periphery of the inner tubular portion 31. The front end side of the final locking projection 71 is a vertical surface orthogonal to the holder mounting direction, and the rear end side is an inclined surface.

In the housing 13, a plurality of (in the present embodiment, a pair of left and right, i.e., a total of two) temporary locking projections 73 for temporarily locking the rear holder 21 are projected from the outer periphery of the inner tubular portion 31. The front end side of the temporary locking projection 73 is a vertical surface orthogonal to the holder mounting direction, and the rear end side is an inclined surface.

The rear holder 21 is attached to the rear end surface of the inner tubular portion 31 on the housing 13. A plurality of terminal insertion openings 19 that allow the terminal 17 to be inserted from the rear are formed in the rear holder 21. The rear holder 21 is preferably integrally molded with a resin material having excellent mechanical strength, such as POM (polyoxymethylene).

The rear holder 21 has a plurality of holder final locking arms 75 for attaching to the housing 13 and a plurality of holder temporary locking arms 77 for temporarily locking the housing 13. The rear holder 21 is mounted on the housing 13 at two positions on a straight line, i.e., a temporary locking position and a final locking position by the holder temporary locking arms 77 and the holder final locking arms 75. In the present embodiment, a pair of upper and lower and a pair of left and right, i.e., a total of four holder final locking arms 75 are provided. A pair of left and right, i.e., a total of two holder temporary locking arms 77 are provided.

The base end of the holder temporary locking arm 77 is supported by the left and right portions of the rear holder 21, and the insertion tip end becomes the free end. The holder temporary locking arm 77 has a temporary locking part 79 at its tip end. The temporary locking part 79 is locked to the temporary locking projection 73 of the housing 13. The temporary locking part 79 of the holder temporary locking arm 77 is locked to the temporary locking projection 73, so that the rear holder 21 is held in the housing 13 in a temporary locking state as shown in FIG. 3A. At this time, the temporary locking part 79 of the holder temporary locking arm 77 rides over the temporary locking projection 73, so that it is possible to further insert the rear holder 21 from the temporary locking state to the final locking state.

The base end of the holder final locking arm 75 is supported by the upper and lower portions and left and right portions of the rear holder 21, and the insertion tip end becomes the free end. The holder final locking arm 75 has a locking part 81 at its tip end. The locking part 81 is locked to the final locking projection 71 of the housing 13. The locking part 81 of the holder final locking arm 75 is locked to the final locking projection 71, so that the rear holder 21 is held in the housing 13 in a final locking state as shown in FIG. 3B.

The holder temporary locking arms 77 and the temporary locking projections 73 configure a temporary locking mechanism. Incidentally, when the holder final locking arms 75 are slightly shorter than the holder temporary locking arms 77 and the temporary locking parts 79 of the holder temporary locking arms 77 are locked to the temporary locking projections 73, the locking parts 81 are positioned at the rear end sides with respect to the final locking projections 71 so as not to be locked.

The rear holder 21 has a retainer part 69 shown in FIG. 2. When the rear holder 21 is at the temporary locking position, the retainer part 69 is disposed at a position just before the housing flexible piece 61 is engaged. When the rear holder 21 is at the final locking position, the retainer part 69 is disposed at a position that restrains the locking release of the housing flexible piece 61. When the rear holder 21 is mounted on (finally locked with) the housing 13, the retainer part 69 enters the flexible space 67. The retainer part 69 is engaged with the housing flexible piece 61 to restrain the locking release of the housing flexible piece 61. That is, the retainer part 69 restrains the movement of the housing flexible piece 61 which locks the terminal 17 to the flexible space 67, and performs double locking to ensure that the terminal 17 is locked so as not to come off.

As described above, in the charging connector 100, a temporary locking mechanism is provided between the housing 13 and the rear holder 21. When the rear holder 21 is in a temporary locking state with respect to the housing 13, the retainer part 69 is not engaged with the housing flexible piece 61; when the rear holder 21 is in a final locking state, the retainer part 69 is engaged with the housing flexible piece 61. When the rear holder 21 is at the temporary locking position, the housing flexible piece 61 can be moved to the flexible space 67, so that it is possible to insert the terminal 17 from the terminal insertion opening 19.

On the rear end surface of the inner tubular portion 31, each of the terminal accommodating chambers 11 of the housing 13 is open. The opening of each of the terminal accommodating chambers 11 is disposed in a straight line with the terminal insertion opening 19 of the rear holder 21 temporarily locking the inner tubular portion 31 and communicates with the terminal insertion opening 19. Therefore, in the charging connector 100, the terminal 17 can be inserted into each of the terminal accommodating chambers 11 via the terminal insertion opening 19 of the rear holder 21 temporarily locking the inner tubular portion 31.

Figure 4:
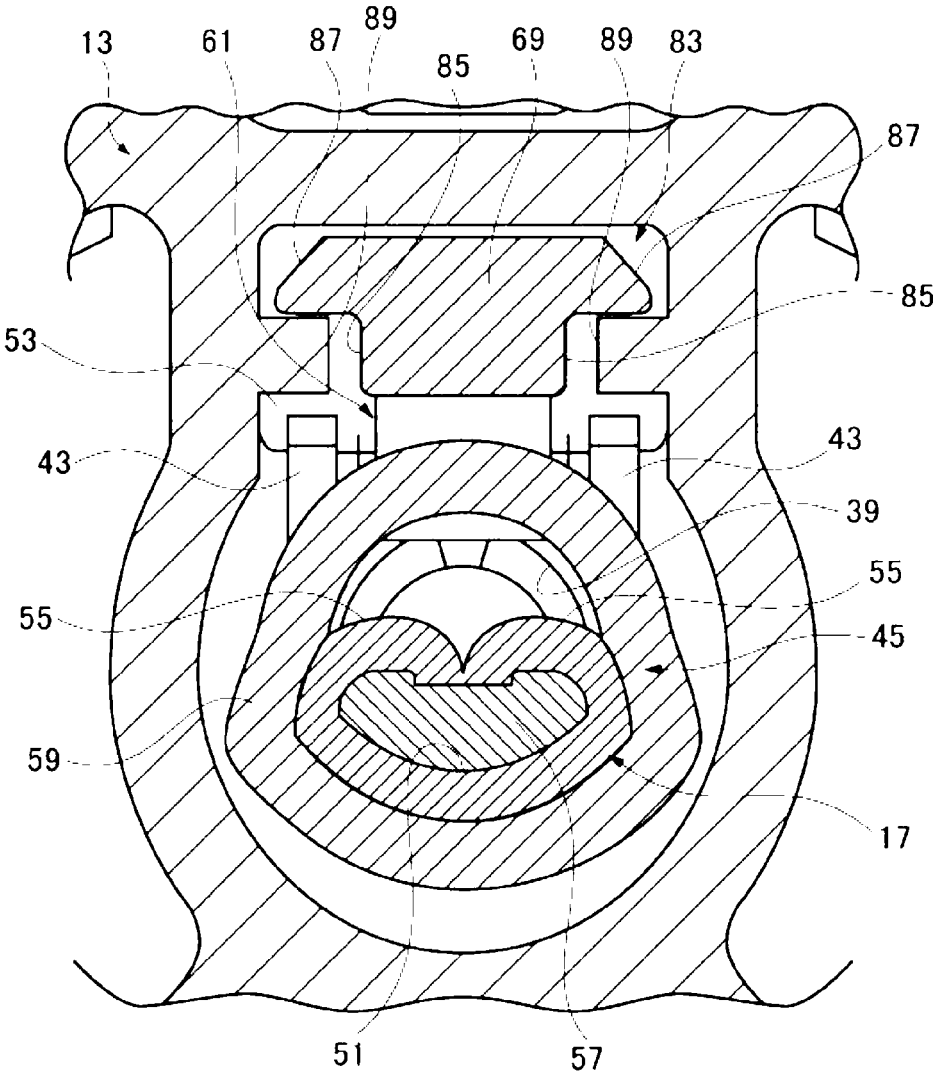
FIG. 4 is a view seen from the direction of an arrow A-A in FIG. 2.

FIG. 4 is a view seen from the direction of an arrow A-A in FIG. 2.

The housing 13 has a rail part 83 along the retainer part 69 of the rear holder 21. In the retainer part 69, a sectional shape orthogonal to the insertion direction is formed in a sectional T-shaped section having cutout parts 85 at the lower portion of both side surfaces. That is, overhanging parts 87 extend in the insertion direction on the upper portions of both side surfaces of the retainer part 69. The rail part 83 has a pair of projection strips 89 projecting into the left and right cutout parts 85 of the retainer part 69. The lower surfaces of the overhanging parts 87 are placed on the respective projection strips 89. That is, the overhanging parts 87 of the retainer part 69 are supported on the upper surfaces of the projection strips 89. By bringing the projection strips 89 into sliding contact with the overhanging parts 87, the rail part 83 restrains the inclination of the retainer part 69 in the inclination direction (the lower direction in FIG. 2) with respect to the rear holder mounting direction (the direction of arrow a in FIG. 2) of the retainer part 69.

The inclination of the retainer part 69 is caused, for example, by inserting the rear holder 21 downward. The tip end of the inclined retainer part 69 may hit the housing flexible piece 61. However, even if the rear holder 21 is inserted downward, the retainer part 69 according to the present configuration example restrains the inclination of the overhanging parts 87 against the projection strips 89.

The front holder 25 shown in FIG. 2 is mounted on the connector fitting part 27 of the housing 13. The front holder 25 has a tubular front holder main body 91 formed with an outer diameter substantially the same as the outer diameter of the connector fitting part 27. An annular sealing member 23 made of an elastic material such as rubber is mounted on the outer periphery of the front holder main body 91. The sealing member 23 elastically contacts (resiliently contacts) the inner peripheral wall of the mating connector 33 to water-tightly seal the gap between the mating connector 33 and the connector fitting part 27.

A plurality of front flexible pieces 93 projecting toward the rear of the housing 13 are formed in the front holder main body 91. The front flexible piece 93 is formed in a cantilever shape having a base part connected to the front holder main body 91, and the free end (the projecting tip end) on the side opposite to the base portion extends toward the rear of the housing. A locking stepped part 95 is formed at the projecting tip end of the front flexible piece 93. The locking stepped part 95 is locked to a front locking part 97 formed inside the housing 13. In the housing 13, a front flexible space 99 for moving the front flexible piece 93 locked to the front locking part 97 in the locking release direction is formed.

In the rear holder 21, front retainer parts 101 projecting forward are formed. The front retainer part 101 is inserted into the front flexible space 99 after the front holder 25 is mounted. The front retainer part 101 is inserted into the front flexible space 99, so that the front retainer part 101 is engaged with the front flexible piece 93 to restrain the locking release of the front flexible piece 93. That is, the front retainer part 101 restrains the movement of the front flexible piece 93 which is locked to the front locking part 97 to the front flexible space 99 and performs double locking to ensure that the front flexible piece 93 is locked so as not to come off.

Next, an assembling procedure of the charging connector 100 having the above configuration will be described.

Prior to describing the procedure for assembling the charging connector 100 according to the present embodiment, the assembling procedure of the connector according to the comparative example to which the terminal 17 is attached in advance will be described.

Figure 5:
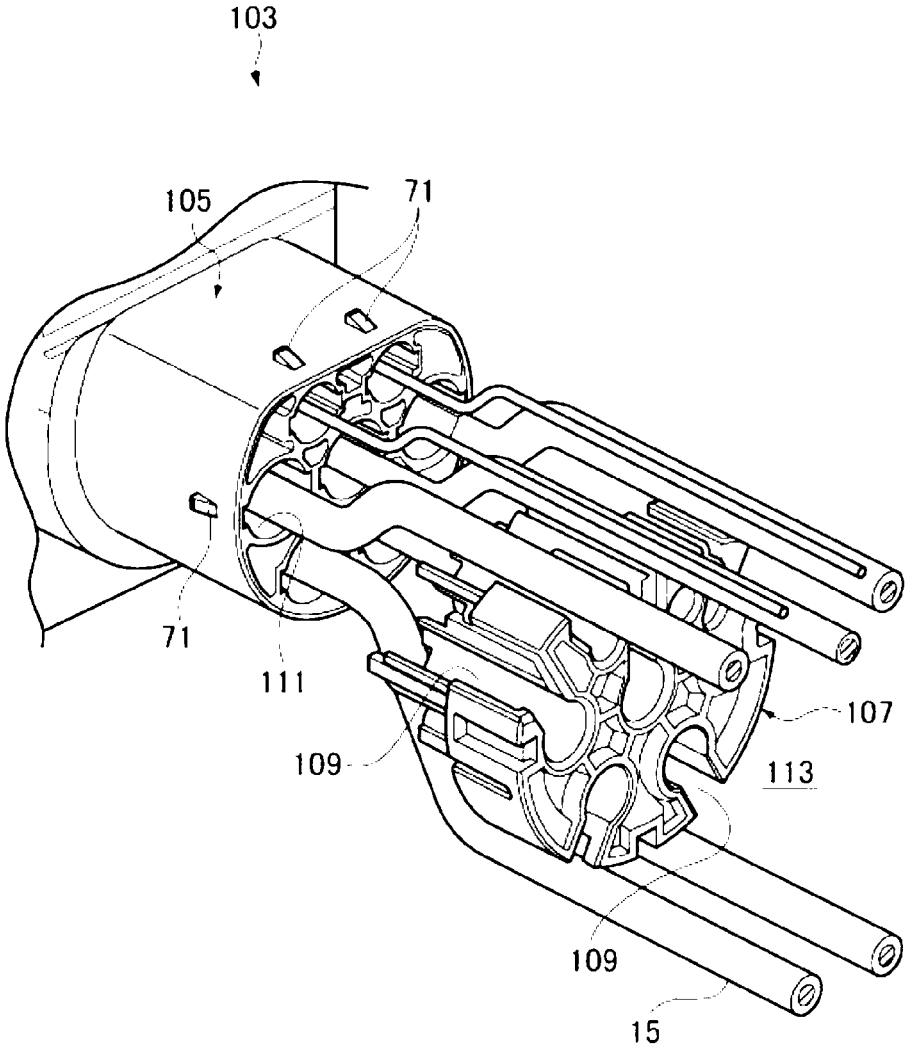
FIG. 5 is a perspective view of a connector according to a comparative example in which a terminal has a pre-attached structure as viewed obliquely upward from the rear left side.

FIG. 5 is a perspective view of a terminal pre-attached connector 103 according to a comparative example in which the terminal 17 has a pre-attached structure as viewed obliquely from the rear left side.

The terminal pre-attached connector 103 according to the comparative example has a housing 105 which accommodates the terminals and a rear holder 107 which is mounted on the rear end of the housing 105 and holds the terminals by the housing 105. Slits 109 for setting the electric wires 15 connected to the terminals 17 are formed in the rear holder 107.

When the terminal pre-attached connector 103 is pre-attached, a plurality of terminals are first inserted into terminal accommodating chambers 111 of the housing 105, respectively.

Next, a space 113 is created by placing a plurality of electric wires 15 vertically. Next, the rear holder 107 is passed through the formed space 113. Then, the electric wires 15 are set in the slits 47 of the rear holder 107.

Finally, the rear holder 107 is mounted on the rear end of the housing 105, the terminal is prevented from coming off by the rear holder 107, and the assembly of the terminal pre-attached connector 103 is completed.

However, in the terminal pre-attached connector 103 according to the comparative example described above, the procedure for assembling the rear holder 107 to the housing 105 so as to prevent the terminals from coming off is complicated, and in addition, since the electric wires 15 are entangled, the work becomes difficult. Further, the terminals cannot be prevented from coming off the housing 105 until the rear holder 107 is mounted on the housing 105, and the terminals may deviate from proper positions. In a state where the terminals deviate from the proper positions, when the rear holder 107 is assembled, the terminal holding force cannot be obtained, which may cause assembly failure.

Figure 6A:
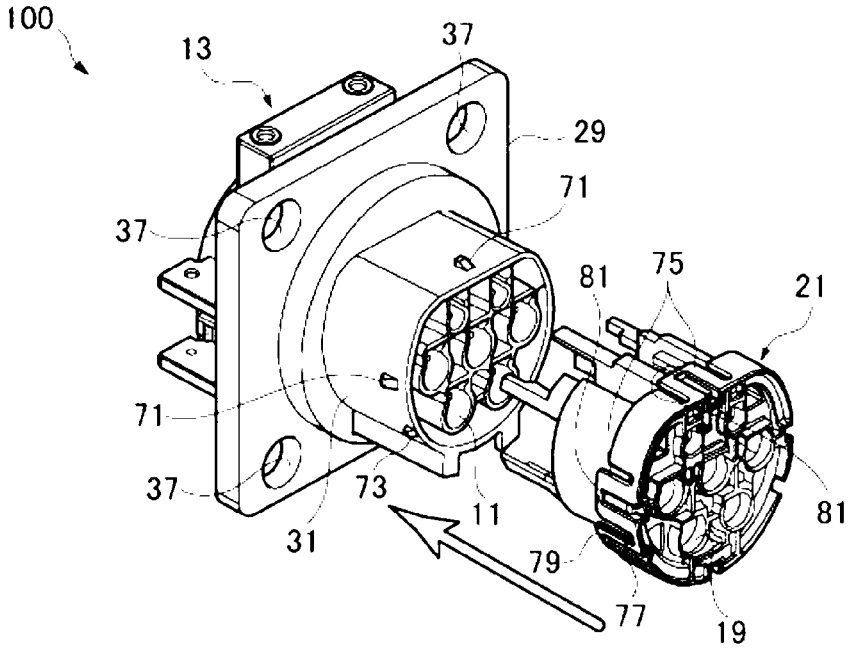
FIG. 6A is a perspective view of the connector shown in FIG. 1 before the rear holder is mounted.
Figure 6B:
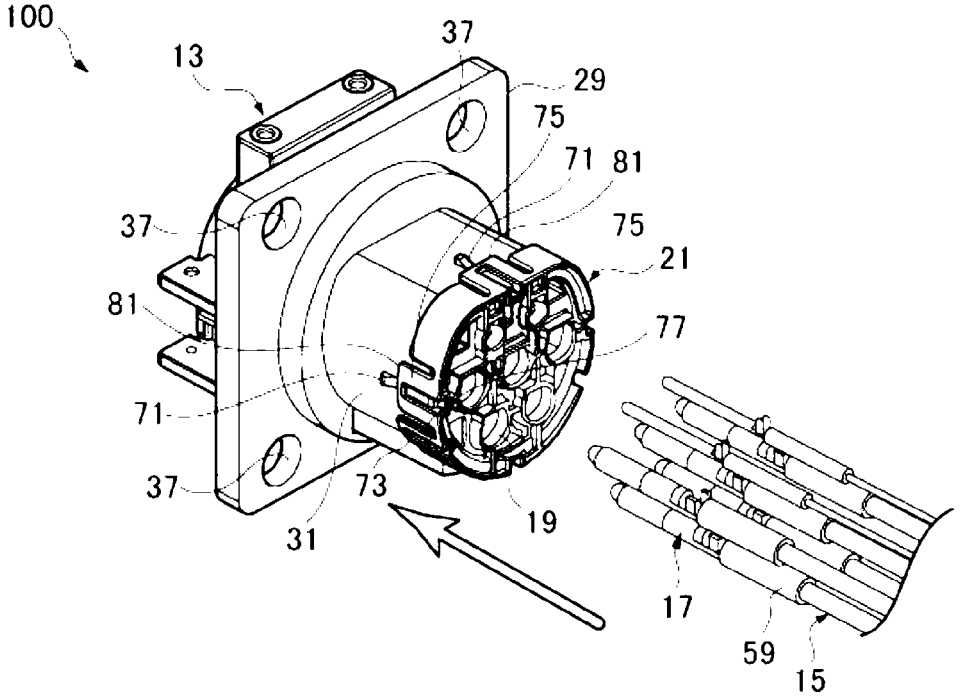
FIG. 6B is a perspective view of the connector shown in FIG. 1 when the rear holder is at the temporary locking position.

FIG. 6A is a perspective view of the charging connector 100 shown in FIG. 1 before the rear holder 21 is mounted, and FIG. 6B is a perspective view of the charging connector 100 when the rear holder 21 is at the temporary locking position.

In order to assemble the charging connector 100 of the present embodiment, firstly, the front holder 25 is mounted on the connector fitting part 27 of the housing 13.

Next, the rear holder 21 is mounted on the inner tubular portion 31 of the housing 13 in a temporary locking state. That is, the rear holder 21 is mounted before the terminals 17 are mounted. As shown in FIG. 3A, the locking part 81 of the holder temporary locking arm 77 is locked to the temporary locking projection 73 of the housing 13, so that the rear holder 21 is mounted on the housing 13 at the temporary locking position.

When the rear holder 21 is at the temporary locking position, the retainer part 69 is disposed at a position just in front of the flexible space 67. The housing flexible piece 61 can be deflected since the retainer part 69 does not enter the flexible space 67. That is, in the rear holder 21, the housing flexible piece 61 can be deflected in the flexible space 67, so that it is possible to insert the terminal 17 from the rear.

Next, the terminal 17 connected to the end portion of the electric wire 15 is inserted into the terminal accommodating chamber 11 through the terminal insertion opening 19 of the rear holder 21. At this time, when the dome part 49 of the terminal 17 abuts the projecting tip end of the housing flexible piece 61, since the housing flexible piece 61 shown in FIG. 2 is flexibly deformed and pushed up, the insertion of the terminal 17 is allowed.

When the terminal 17 is inserted deeper, the locking stepped part 65 of the housing flexible piece 61 coincides with the locking rear end portion 41 of the terminal 17, returns to the original position by the elastic restoring force and locks the locking rear end portion 41. When the terminal 17 is inserted into a position where the rising parts 43 abut the stopper step part 53, further insertion of the terminal 17 is restrained.

Figure 7A:
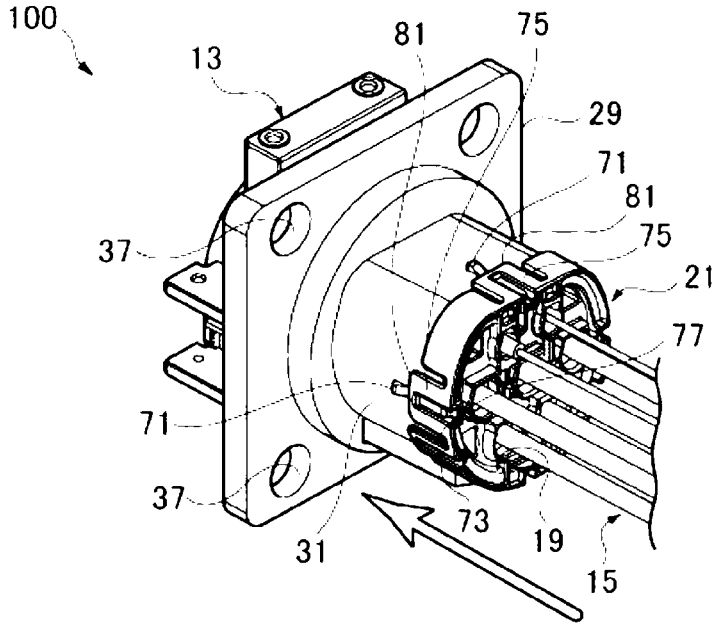
FIG. 7A is a perspective view of the connector shown in FIG. 1 into which an electric wire with a terminal is inserted.
Figure 7B:
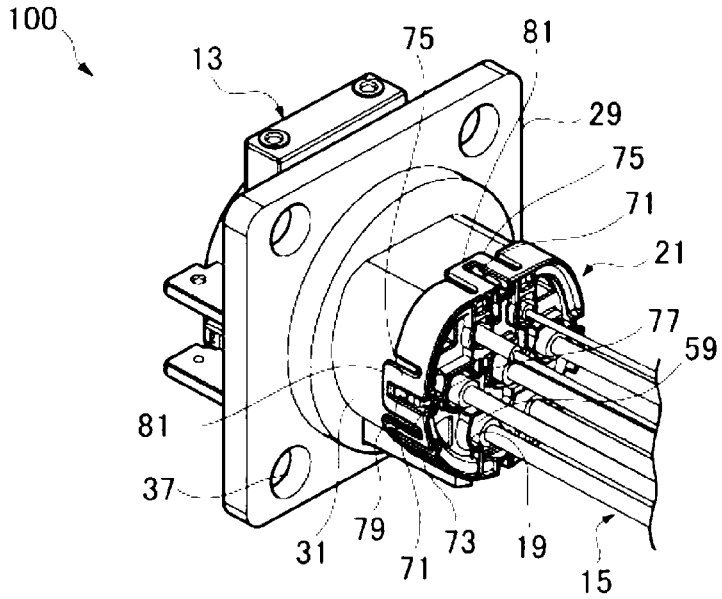
FIG. 7B is a perspective view of the connector shown in FIG. 1 when the rear holder is at a final locking position.

FIG. 7A is a perspective view of the charging connector 100 shown in FIG. 1 into which an electric wire with a terminal (the electric wire 15 whose terminal 17 is connected to the end portion) is inserted, and FIG. 7B is a perspective view of the charging connector 100 shown in FIG. 1 when the rear holder 21 is at the final locking position.

After the insertion of all the terminals 17 is completed in this way, the rear holder 21 is pushed into the final locking position of the housing 13. The locking part 81 of the holder final locking arm 75 is locked to the final locking projection 71 of the housing 13, so that the rear holder 21 is held in the housing 13 at the final locking position (see the state in FIG. 2).

When the rear holder 21 comes into a final locking state, the retainer part 69 enters the flexible space 67. The deflection of the housing flexible piece 61 in the locking release direction is blocked by the retainer part 69 entering the flexible space 67 and locks the terminal 17 in a double locking state. In the rear holder 21, the front retainer part 101 enters the front flexible space 99. The deflection of the front flexible piece 93 in the locking release direction is blocked by the front retainer part 101 which enters the front flexible space 99 and locks the front holder 25 in a double locking state. In the charging connector 100, the terminal 17 and the front holder 25 are double locked, and the assembly is completed.

Next, the function of the above configuration will be described.

In the charging connector 100 according to the present embodiment, the rear holder 21 is mounted on the housing 13 at the temporary locking position before the terminal 17 is mounted. The rear holder 21 includes the terminal insertion openings 19. In the housing 13, the terminal 17 can be inserted into the terminal accommodating chamber 11 through the terminal insertion opening 19 of the rear holder 21 mounted on the temporary locking position. Since the mounting work of the terminal 17 can be assembled in a state where the rear holder 21 is temporarily locked, it is unnecessary to perform a difficult operation such as pushing through the electric wire 15 as in the terminal pre-attached connector 103 according to the comparative example. As a result, the assembly work of the charging connector 100 can be facilitated.

When the terminal 17 is inserted into the terminal accommodating chamber 11, the terminal 17 is locked to the housing flexible piece 61 and the separation of the terminal 17 from the terminal accommodating chamber 11 in a direction opposite to the insertion direction is restrained. The rear holder 21 is at the final locking position by further moving from the temporary locking position in the rear holder mounting direction. The rear holder 21 is at the final locking position, so that the retainer part 69 is inserted into the flexible space 67 of the housing flexible piece 61. The retainer part 69 is inserted into the flexible space 67 of the housing flexible piece 61, so that locking release with respect to the terminal 17 is restrained (the terminal 17 is in a double locking state). That is, the terminal 17 is brought into a double locking state, and the holding reliability is improved. As a result, the charging connector 100 can prevent the assembly failure through the deviation of the terminal 17.

When the rear holder 21 is moved to the final locking position, the retainer part 69 is guided by the rail part 83. The retainer part 69 is guided while being in sliding contact with the rail part 83, so that the inclination in the inclination direction with respect to the rear holder mounting direction is restrained. Even if the rear holder 21 is mounted through the guide action of the rail part 83 in an inclined way, the retainer part 69 does not contact the housing flexible piece 61 locked to the terminal 17 in the proper position. That is, since the contact of the retainer part 69 with the housing flexible piece 61 is suppressed in the rear holder 21, smooth mounting work can be performed. The assembly work of the charging connector 100 can be facilitated because of the smooth mounting property.

Further, in the charging connector 100, when the terminal 17 is not set at the proper position (hereinafter also referred to as "half insertion"), the housing flexible piece 61 is not engaged with the terminal 17. When the housing flexible piece 61 is not engaged, the housing flexible piece 61 is disposed at a position in contact with the retainer part 69. The retainer part 69 abuts the housing flexible piece 61, so that the insertion of the rear holder 21 is prevented. That is, by not allowing the insertion of the rear holder 21, the charging connector 100 can detect that the terminal 17 is in a half-insertion state. The charging function of the charging connector 100 can prevent the assembly failure of the terminal 17 beforehand.

Further, in the charging connector 100 according to the present embodiment, the front holder 25 is mounted on the connector fitting part 27 of the housing 13. The front flexible piece 93 is locked to the front locking part 97 of the housing 13, so that the separation of the front holder 25 from the connector fitting part 27 is restrained. The front holder 25 is provided with a sealing member 23. When the mating connector 33 is fitted to the connector fitting part 27, the sealing member 23 water-tightly seals the gap between the connector fitting part 27 and the mating connector 33. Since the seal member 23 is in sliding contact with the mating connector 33, the front holder 25 is required to have high holding performance with respect to the housing 13. That is, when the mating connector 33 is pulled out, the separation of the front holder 25 from the housing 13 by friction must be surely prevented. In the charging connector 100, the rear holder 21 is at the final locking position, so that the front retainer part 101 of the rear holder 21 is engaged with the front flexible piece 93 of the front holder 25. The front retainer part 101 is engaged with the front flexible piece 93, so that the locking release with respect to the front locking part 97 is restrained. That is, the front holder 25 is in a double locking state. As a result, the charging connector 100 can suppress the assembly failure through the deviation of front holder 25.

Further, in the charging connector 100, when the front housing 25 is not set at the proper position, the front flexible piece 93 is not engaged with the locking part 97. When the front flexible piece 93 is not engaged, the front flexible piece 93 is disposed at a position in contact with the front retainer part 101. The front retainer part 101 abuts the front flexible piece 93, so that the insertion of the rear holder 21 is prevented. By not allowing the insertion of the rear holder 21, the charging connector 100 can detect that the front holder 25 is in the half-insertion state. The charging function of the charging connector 100 can prevent the assembly failure of the front holder 25 beforehand.

According to the charging connector 100 of the present embodiment, the assembly work can be facilitated and the assembly failure can be prevented.

The present invention is not limited to the above-described embodiment, but may be appropriately modified, improved, or the like. In addition, materials, shapes, dimensions, numbers, disposition locations, or the like of the constituent elements in the above-described embodiments are arbitrary and are not limited as long as the present invention can be achieved.

Further, characteristics of the embodiments of the connector according to the present invention described above are summarized briefly in the following [1] to [2], respectively.

[1] A connector (a charging connector 100), comprising: a housing (13) which has a plurality of terminal accommodating chambers (11) into which terminals (17) are inserted and a housing flexible piece (61) for locking so as to prevent the terminals (17) from coming off in each of the terminal accommodating chambers (11);

a rear holder (21) which includes terminal insertion openings (19) allowing insertion of the terminal (17) and is mounted on the housing (13) at two positions on a straight line, i.e., a temporary locking position and a final locking position, the retainer part (69) being disposed at a position just before the housing flexible piece (61) is engaged when the rear holder (21) is at the temporary locking position, and the retainer part (69) being disposed at a position that restrains the locking release of the housing flexible piece (61) when the rear holder (21) is at the final locking position; and a rail part (83) which is formed in the housing (13), sliding contacts the retainer part (69) and restrains the inclination in the inclination direction with respect to the rear holder mounting direction of the retainer part (69).

[2] The connector (the charging connector 100) according to [1] described above, wherein the housing (13) is formed with a connector fitting part (27) whose outer periphery is coupled to the mating connector (33), a front holder (25) including an annular sealing member (23) elastically contacting the mating connector (33) is mounted on the connector fitting part (27), a front flexible piece (93) locking a front locking part (97) formed in the housing (13) is formed in the front holder (25), and a front retainer part (101) engaged with the front flexible piece (93) and restraining the locking release of the front flexible piece (93) is formed in the rear holder (21).

What is claimed is:

1. A connector, comprising:

a housing that has a plurality of terminal accommodating chambers into which terminals are inserted in an insertion direction and a housing flexible piece for locking the terminals and preventing the terminals from coming off in each of the terminal accommodating chambers;

a rear holder that has a retainer part and includes terminal insertion openings allowing insertion of the terminals therethrough and is mounted on the housing in the insertion direction at two positions on a straight line, the two positions being a temporary locking position and a final locking position, the retainer part being disposed at a position just before the retainer part is engaged with the housing flexible piece when the rear holder is at the temporary locking position, and the retainer part is disposed at a position where the retainer part restrains the locking release of the housing flexible piece when the rear holder is at the final locking position; and a rail part that is formed in the housing and restrains a movement of the retainer part in an inclination direction with respect to a mounting direction of the retainer part by slide contact to the retainer part.

2. The connector according to claim 1, wherein the housing is formed with a connector fitting part having an outer periphery to which a mating connector is connectable, a front holder including an annular sealing member elastically contacting the mating connector is mounted on the connector fitting part, the front holder is formed with a front flexible piece which engages with a front locking part formed in the housing, and a front retainer part engaged with the front flexible piece and restraining the locking release of the front flexible piece is formed in the rear holder.

3. The connector according to claim 2, wherein the housing includes a front flexible space into which the front flexible piece is capable to enter, and wherein the front retainer part is configured to be inserted into the front flexible space so as to prevent the front flexible piece from entering into the front flexible space.

4. The connector according to claim 1, wherein the housing flexible piece includes a projecting tip end which is to be engaged with the terminal, wherein the terminal accommodating chamber includes a flexible space into which the projecting tip end is capable to enter, and wherein the retainer part is configured to be inserted into the flexible space so as to prevent the projecting tip end from entering into the flexible space.

5. The connector according to claim 1, wherein the rear holder is attached to a rear end surface of the housing.

6. The connector according to claim 5, wherein the terminal insertion openings are formed in the rear holder to allow the terminals to be inserted from the rear.

* * * * *